United States Patent [19]

Knabel et al.

[11] Patent Number: 4,537,418

[45] Date of Patent: Aug. 27, 1985

[54] SKI BRAKE

[75] Inventors: Walter R. Knabel, Murnau; Gerhard J. Sedlmair, Farchant, both of Fed. Rep. of Germany

[73] Assignee: Marker International, Salt Lake City, Utah

[21] Appl. No.: 358,372

[22] Filed: Mar. 15, 1982

[30] Foreign Application Priority Data

Mar. 19, 1981 [DE] Fed. Rep. of Germany ..... 3110743

[51] Int. Cl.[3] ..... A63C 7/10

[52] U.S. Cl. ..... 280/605

[58] Field of Search ..... 280/605, 12 AB, 633, 280/636, 620

[56] References Cited

U.S. PATENT DOCUMENTS

| | | | |
|---|---|---|---|
| 4,239,256 | 12/1980 | Krob | 280/605 |
| 4,262,926 | 4/1981 | Riedel | 280/605 |
| 4,266,801 | 5/1981 | Salomon | 280/605 |
| 4,371,187 | 2/1983 | Svoboda et al. | 280/605 |
| 4,379,570 | 4/1983 | Sedlmair | 280/605 |

FOREIGN PATENT DOCUMENTS

| | | | |
|---|---|---|---|
| 2462234 | 5/1976 | Fed. Rep. of Germany | 280/605 |
| 2632850 | 1/1978 | Fed. Rep. of Germany | 280/605 |

*Primary Examiner*—David M. Mitchell

*Attorney, Agent, or Firm*—Woodling, Krost, Rust and Hochberg

[57] ABSTRACT

A pedal-actuated ski brake which is biased into the braking position. The ski brake may be easily released from the biasing device so as to permit the ski brake to be released into a non-braking position permitting free access to the sides and bottom of the ski.

2 Claims, 2 Drawing Figures

SKI BRAKE

This invention relates to ski brakes. In particular, it relates to ski brakes that are actuated when the ski boot releases pressure on a pedal.

A particular problem with prior art ski brakes involves the obstacle they cause to working on the sides and bottom of the ski. When a ski boot is removed from prior art ski brakes, the brakes are put into the braking position which means that the brake prongs extend downward along the sides of the ski and below the ski, thereby making it difficult or impossible to work on the sides and bottom of the ski.

A ski brake according to the present invention permits the bottom and sides of the ski to be worked on without the necessity of either removing the ski brake or using special means to hold the brake prongs out of the way.

Preferably a ski brake according to the invention comprises lever means in the form of a two-armed lever formed from round wire and having a pivot shaft with an axis of rotation that is generally transverse to the lengthwise direction of the ski. The lever has a lower arm on one side of the pivot shaft which forms the brake prong of the ski brake, and an upper arm on the other side of the pivot shaft attached to one end of a pedal. The other end of the pedal is rotatably attached to one end of an actuating arm. The other end of the actuating arm is fixed to the ski at a distance from the pivot shaft of the wire piece. The actuating arm is biased by a spring so that when there is no downward pressure on the pedal (such as when there is no ski boot pressing on the pedal), the spring rotates the actuating arm to lift the pedal, which rotates the wire piece and moves the lower arm into the braking position. A novel feature of the invention involves the attachment of the actuating arm to the pedal by means of a pin on the end of the actuating arm which is received in a slot in the pedal. The pin can be removed from the slot, thereby freezing the pedal from the actuating arm. When the pedal is released from the actuating arm, its weight causes the lower arm of the wire piece to rotate upward out of the brake position, thereby taking the brake prong out of the way from work on the bottom or sides of the ski.

DETAILED DESCRIPTION OF THE PREFERRED EMBODIMENT

Figure 1:
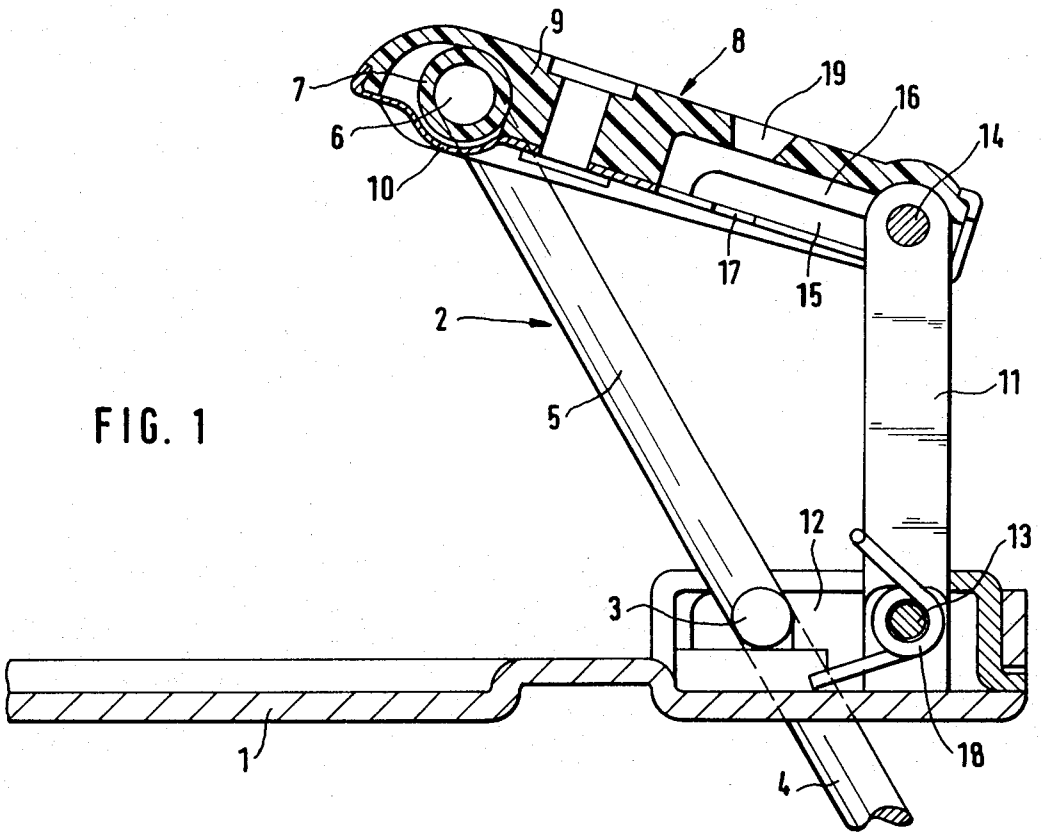
FIG. 1 is a side elevational view, in cross-section, of the ski brake in its braking position.

Referring to the drawings, a ski brake according to the preferred embodiment is shown as having a base plate 1 which is conventionally mounted to the top of the ski by screws (not shown). The base plate 1 can also serve as a mounting support for an associated safety ski binding. Since the drawings are in cross-section, only part of the ski brake is illustrated and it should be understood that the remainder of the ski brake is a mirror image of the portion illustrated.

As is typical of some ski brakes, there is a lever means comprising a wire piece 2 which is bent to have two lever arms, a lower arm 4 and an upper arm 6, on either side of a central portion 3. The lower arm 4 of the wire piece comprises the brake prong and acts to engage the snow when the ski brake is in the braking position illustrated in FIG. 1. The central portion 3 of the wire piece acts as a pivot shaft and has an axis of rotation transverse to the length of the ski. The free end of the upper arm 5 of the wire piece terminates in a bent end 6. Such a wire piece 2 is provided on each side of the ski so as to provide a brake prong 4 on each side of the ski.

The ski brake further comprises a pedal 8 which has a plastic top member 9 and a metal bottom member 10. The bent end 6 of each upper arm 5 of each wire piece 2 is rotatably received in a socket 7 in the front of the pedal 8. This firmly attaches each wire piece 2 to pedal 8, but permits each plate 2 to rotatably move with respect to pedal 8 about an axis of rotation generally transverse to the length of the ski. When the pedal is pressed down (as by a ski boot) the wire piece is rotated counterclockwise so that the brake prong no longer extends below the ski.

The ski brake further comprises a shaft 13 mounted generally transverse to the length of the ski between two brackets 12 on the base plate 1. The lower end of an actuating arm 11 is mounted on shaft 13 so that actuating arm 11 may rotatably move with respect to base plate 1 about an axis of rotation generally transverse to the length of the ski. A coiled spring 18 is mounted on shaft 13 to bias actuating arm 11 clockwise towards the vertical position shown in FIG. 1.

Pedal 8 is attached to actuating arm 11 by means of at least one retaining pin 14 provided on the upper end of actuating arm 11. Pedal 8 has a slot 15 for receiving pin 14. Slot 15 is formed between metal bottom 10 of pedal 8 and a grooved member 16 of plastic top 9. Bolt 14 is assembled into pedal 8 by sliding pin 14 through insertion opening 17 of slot 15 in bottom 10 of pedal 8. When pedal 8 and actuating arm 11 are thus assembled, they are still able to rotate with respect to each other with pin 14 acting as a pivot shaft.

It can now be appreciated that when pin 14 is received in slot 15 of pedal 8, the assembly forms a knee lever in which pedal 8 acts as an upper lever arm and actuating arm 11 acts as a lower lever arm.

To place the ski brake in the braking position (shown in FIG. 1), spring 18 rotates actuating arm 11 clockwise to the vertical position, arm 11 in turn carries pedal 8 up, which in turn rotates wire piece 2 about the axis of pivot shaft 3, to thereby rotate lower arm 4 clockwise into the braking position.

A novel aspect of the ski brake involves an access aperture 19 provided in plastic top 9 of pedal 8. Preferably access aperture 19 provides access to the central portion of slot 15 and is above insertion opening 17. Access aperture 19 allows pedal 8 and actuating arm 11 to be easily separated, thereby relieving wire piece 2 from the force of spring 18 so that wire piece 2 can be freely rotated.

A scewdriver or the like (shown in dotted line in FIG. 2) may be introduced through access aperture 19 to facilitate movement of retaining pin 14 out through insertion opening 17. Upon release of pedal 8 from actuating arm 11, wire piece 2 becomes freely movable about its pivot shaft 3. Thus, the ski brake can be easily handled and provides no impediment to handling and working on the bottom or sides of the ski. Indeed, the combined weight of pedal 8 and upper arms 5 (especially due to the acting of the weight of pedal 8 at the end of the lever arm formed by upper arm 5) causes wire piece 2 to rotate about its pivot shaft 3 and put lower arm 4 in the non-braking position so that the brake prongs are held out of the way by the force of gravity.

Figure 2:
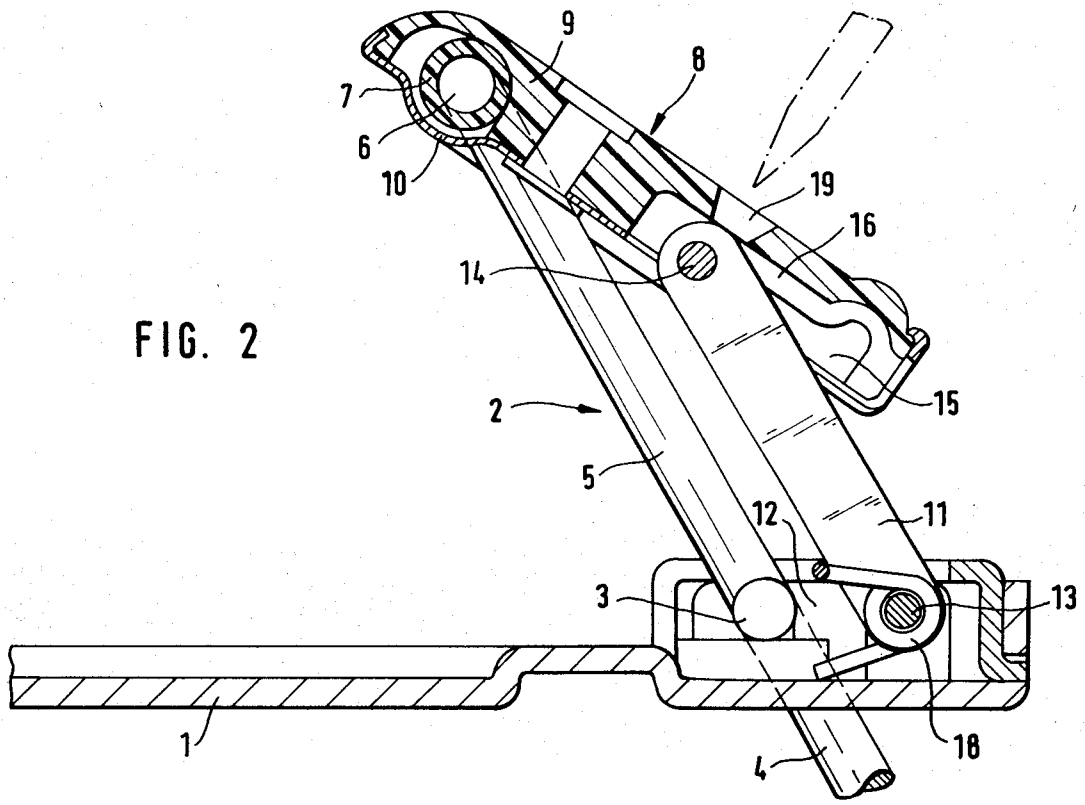
FIG. 2 is a side elevational view, in cross-section, of the ski brake in an intermediate position during the disassembling of the boot pedal from the actuating arm.

Pedal 8 and actuating arm 11 can be simply reattached by placing wire piece 2 in the position illustrated in FIG. 2, placing pedal 8 on actuating arm 11, and then, while holding wire piece 2, pushing retaining pin 14 through insertion opening 17 along slot 15 and securing pin 14 between bottom member 10 and grooved member 16. Upon the operator's release of wire piece 2 and pedal 8, the ski brake will then assume the braking position illustrated in FIG. 1.

The invention has been described in detail with particular emphasis on the preferred embodiment thereof, but it will be understood that variations and modifications within the spirit and scope of the invention may occur to those skilled in the art to which the invention pertains.

What is claimed is:

1. A brake for a ski, comprising:

lever means comprising a pivot shaft intermediate a lower lever arm and an upper lever arm, said lever means being rotatable between a braking position in which said lower arm extends below the ski and a non-braking position in which said lower arm does not extend below the ski;

an actuating arm operatively connected to said lever means and movable between a first position wherein said lever means in the braking position and a second position wherein said lever means is in the non-braking position;

a pedal having one portion rotatably attached to said upper arm and another portion rotatably attached to said actuating arm, said pedal having a skiing position for moving said lever means to the non-braking position and a non-skiing position;

biasing means for biasing said actuating arm to said first position to cause said pedal to assume the non-skiing position and move lever means into said braking position; and attaching means for releasably attaching said pedal to said actuating arm, said attaching means comprising a pin on said actuating arm and a slot extending longitudinally in said pedal, said slot having an external opening for receiving said pin, said pedal being released from said actuating arm when said pin is moved out of said slot through said opening;

wherein said pedal includes releasing means for disconnecting said attaching means to release said pedal from said actuating arm.

2. The invention of claim 1, wherein said releasing means comprises an access aperture in said pedal through which a tool may be inserted to aid in releasing said pedal from said actuating arm.

* * * * *